United States Patent [19]

Campanelli

[11] 4,002,488

[45] Jan. 11, 1977

[54] CLEANING, POLISHING, AND DRYING NAILS BY MOVING THEM THROUGH VIBRATORY TROUGHS

[76] Inventor: Tony Campanelli, 243 Flora Parkway, Addison, Ill. 60101

[22] Filed: May 5, 1975

[21] Appl. No.: 574,312

[52] U.S. Cl. ..... 134/7; 34/61; 34/164; 51/5 R; 134/10; 134/25 R; 134/32; 134/63; 209/10

[51] Int. Cl.[2] ..... B08B 3/10

[58] Field of Search ..... 134/7, 10, 18, 19, 25 R, 134/32, 63, 67, 68, 104, 1, 30; 209/10, 329, 346; 34/9, 12, 61, 164; 51/5 R; 198/220 BA

[56] References Cited

UNITED STATES PATENTS

| | | | |
|---|---|---|---|
| 458,571 | 9/1891 | Gedge | 134/33 UX |
| 707,136 | 8/1902 | Mayo | 198/220 BA |
| 1,750,498 | 3/1930 | Truax | 134/7 X |
| 2,633,171 | 3/1953 | Daman | 34/164 X |
| 3,269,534 | 8/1966 | Clark et al. | 198/220 BA |
| 3,871,135 | 3/1975 | Anderson | 198/220 BA |

*Primary Examiner*—S. Leon Bashore
*Assistant Examiner*—Richard V. Fisher
*Attorney, Agent, or Firm*—Richard G. Kinney

[57] ABSTRACT

A process and apparatus for producing nails in polished and clean form comprising means to carry out the steps of providing a continuous flow of nails from a source, subjecting the nails to a vibratory separating mechanism to remove unwanted particles of matter, cleaning the nails by moving same through a vibratory trough while spraying cleaning solution over the nails, and polishing and drying the nails by moving same through a vibratory trough filled with a drying and polishing media while heating the mix within the trough.

10 Claims, 1 Drawing Figure

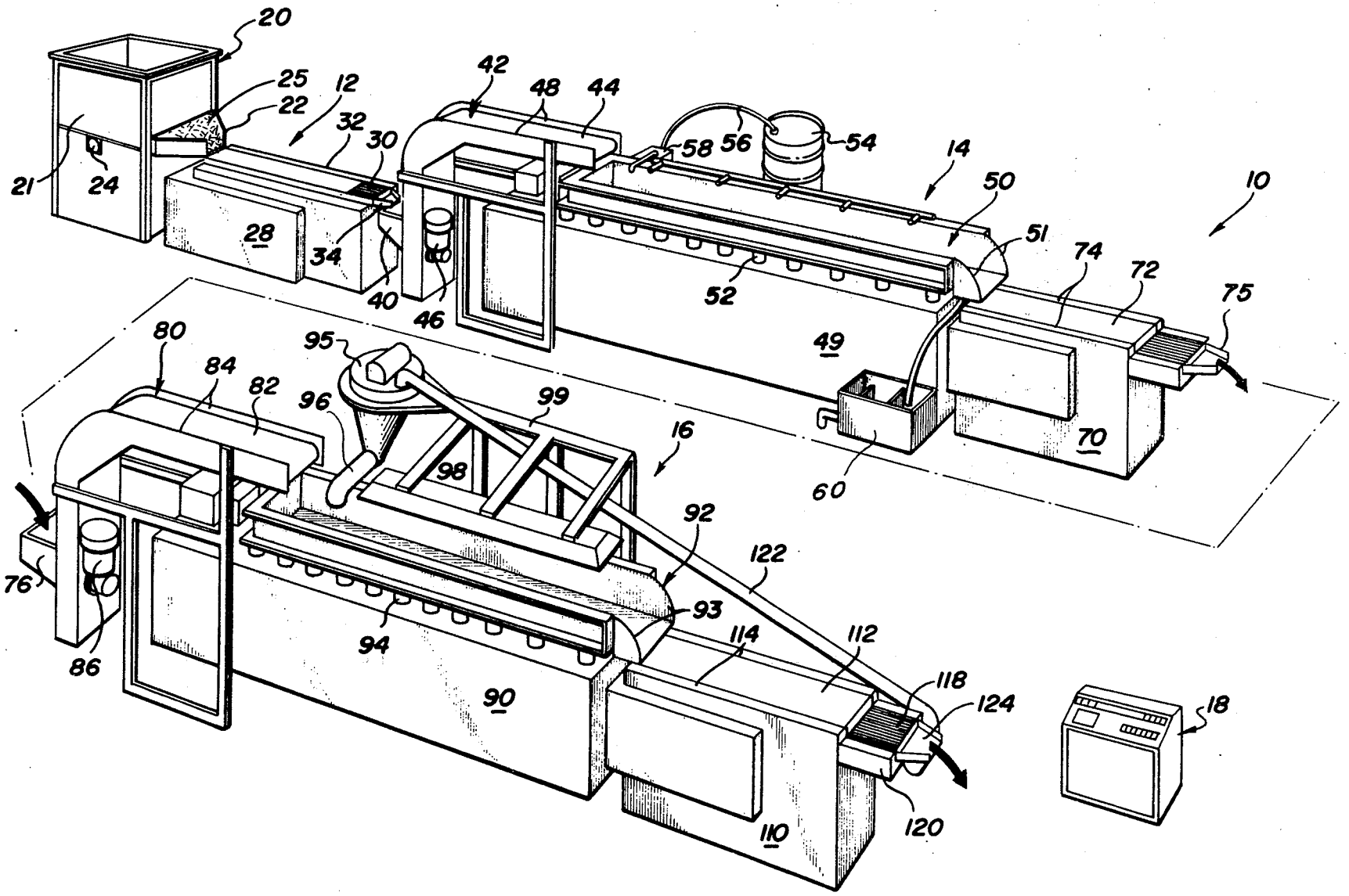
10
75
72
74
70
51
50
14
54
56
58
52
49
60
44
48
42
46
40
30
34
32
12
28
25
22
20
24
21
18
124
118
120
112
122
114
110
92
93
16
99
98
90
94
95
96
82
84
80
86
76

CLEANING, POLISHING, AND DRYING NAILS BY MOVING THEM THROUGH VIBRATORY TROUGHS

SUMMARY OF INVENTION

It is well recognized in the nail making art that means are desirable to process nails from a forming process to clean and polish same in a continuous manner with a minimum amount of labor being involved. The instant apparatus and method achieves this object by providing a continuously operating mechanism which without any manual labor moves the nails through a continuous process which includes a process having the steps and means to carry out same of providing a continuous flow of nails from a source, subjecting the nails to a vibratory separating mechanism to remove unwanted particles of matter, cleaning the nails by moving same through a vibratory trough while spraying cleaning solution over the nails, and polishing and drying the nails by moving same through a vibratory trough filled with a drying and polishing media.

BRIEF DESCRIPTION OF DRAWING

The single FIGURE of drawing illustrates the unique apparatus of the present invention in perspective form.

BRIEF DESCRIPTION OF THE INVENTION

Referring to the single FIGURE of drawing, the unique nail treating apparatus 10 is illustrated which comprises three main sections: separating section 12, cleaning section 14, and drying and polishing section 16. Also illustrated is a control panel section 18 which would be connected to the various electric motors of the units 12, 14 and 16 to control same and to insure adequate flow of material through the apparatus. The apparatus is illustrated in two sections in the drawings comprising the sections 12 and 14 demonstrated in parallel relationship to the polishing and drying section 16. However, in a preferred installation of the subject apparatus, the unit 16 would be in line with units 12 and 14 to provide a continuous flow of nails processed through the mechanism 10.

At the left end of the apparatus, as illustrated in the drawing is a source of nails 20 comprising a hopper 21 which has an output guide 22 connected thereto and includes a vibratory motor 24. Nails 25 are illustrated in the hopper 21 and guide 22. The vibratory motor operates to continuously feed the nails 25 into guide 22 and to the next unit of the apparatus. The nail source 20 is adapted to be filled with nails from the rough forming processes (not illustrated) carried out on the individual nails, which may be either automatically fed into hopper 21 or poured in same by an operator or lift truck.

Nails leaving the hopper mechanism 20 are conveyed by guide 22 onto the separating mechanism 12 which comprises a screen separator apparatus 28. The separator 28 is of the vibratory screen type having a plurality of parallel bars 30 thereon, which receive vibration from the apparatus 28. A longitudinal chute 32 is provided to guide the nails through the separator. The parallel bars 30 are separated by sufficient space to allow unwanted particles such as "wiskers" (the small cutout portions of metal left after a point is cut or formed on the nails) and other unwanted particles to drop between the parallel bars due to the vibratory effect of the machine. The nails are too large to fall between the bars and are conveyed from the left to the right by the vibratory motion as guided in the chute 32. The screen separator, of course, may have parallel bars of different separational distances provided thereon to adapt the mechanism 28 to differing sizes of nails or other similar products. The separating mechanism 28 has a discharge guide 34 thereon. The mechanism for driving the separator 28 is not illustrated, but is of a known type to provide vibration to the unit and feed the nails or other products therethrough.

The guide 34 for the separating mechanism 28 empties into a hopper 40, which is a part of a conveyor mechanism 42. The mechanism 42 consists of a belt conveyor having a neoprene or nylon belt 44 to which nails in the hopper 40 are attracted by a magnetic rail under the belt 44 and conveyed to a higher point for proper feeding to cleaning section 14. The conveyor 42 has a power source 46 adapted to drive the belt 44 and has guiding sides 48 thereon to contain the nails on the moving magnetic belt 44. The output of the conveyor mechanism 42 on the right hand end thereof, as viewed in the drawing, drops the nails to the next processing station namely the cleaning section 14.

Cleaning section 14 is comprised of a vibratory apparatus 49 having a vibration trough type conveyor 50 thereon having guiding sides 51. Vibrating trough 50 is connected to the rest of the mechanism by a series of springs 52 and is adapted to receive a vibratory motion, which operates to move the nails through the trough 50 to the right hand end thereof as viewed in the drawing. The power source for vibrating the trough 50 is not illustrated in the drawing, but is of a known type to provide vibratory motion to the trough 50. In cooperating relationship with trough 50 is a tank of cleaning solution 54 connected by hose 56 with a spraying unit 58. The spraying unit 58 includes a pump (not illustrated) adapted to continuously spray the cleaning solution over the nails as they drop into the trough 50 from conveyor 42 to insure that each nail receives an adequate supply of cleaning solution. The vibratory motion of the trough 50 serves to agitate the nails within the trough as they are moving therethrough and provide a scrubbing action thereof in cooperation with the cleaning solution which is contained within trough 50, but which can slowly drain therefrom to a settlement tank 60. The heavy particles and dirt settle from the cleaning solution within the tank 60 and the solution may be processed for reuse.

The trough 50 empties nails onto another vibratory separating unit 70 which may be of similar construction to mechanism 28 and serves to separate any particles and cleaning solution and feed the nails along the continuous processing line. Separator 70 includes a screen 72 and guiding sides 74 thereon adapted to guide the nails therethrough into discharge guide 75.

Nails from guide 75 drop into a hopper 76 which is a part of a second magnetic feeding device 80 similar to device 42 including a neoprene or nylon belt 82. The moving conveyor belt 82 serves to elevate the nails to a position for proper feeding into the drying and polishing section 16. The unit 80 has sides 84 thereon adapted to confine the nails to the moving belt 82 and a power source 86 is illustrated to drive the magnetic conveyor 80.

The drying and polishing section 16 is comprised of a vibratory trough feeding mechanism 90 similar in construction to unit 49 of cleaning section 14. Apparatus 16 has a trough 92 having sides 93 thereon which is mounted to the unit by a series of springs 94 and the trough 92 receives a vibratory motion serving to feed nails therethrough from their point of entering the trough just below the end of conveyor mechanism 80 to the right hand end thereof as viewed in the drawing. A power source is provided (not illustrated) to vibrate the trough 92. The drying apparatus 16 includes a hopper 95 which is filled with dried and ground corncob material, for example, as a drying and polishing media, which is re-deposited over the nails received in the trough 92 through a large outlet pipe 96. The corncob media serves to absorb liquid from the nails as they move therethrough and also to polish the nails and remove other cleaning oils or dirt particles which may remain. As the nails are vibrated in the trough 92 a scrubbing action will take place between the drying and polishing media and the nails to provide the polishing and drying function. Also provided immediatey over the trough 92 is an infrared heat source 98 which extends parallel to the trough 92 and is supported thereover by a framework 99. The infrared heat source 98 serves to heat the corncob mix as it moves through trough 92 to assist in the drying of the nails being processed.

The nails which are discharged from the right hand end of trough 92 as viewed in the drawing, fall onto an additional separator unit 110 which may be of similar type to units 12 and to having a screen 112 thereon with sides 114 to confine the nails and the screen is given a vibratory motion as with units 28 and 70 and will move the nails from the left to the right as viewed in the drawing. A discharge section 118 is provided on the separating unit 110 which will serve to further separate the drying and polishing media from the nails. The media will fall into a holding space or tank 120 below the unit 118 and a pipe or conduit 122 connects this tank back to hopper 95. The hopper 95 includes a vacuum system for sucking or forcing the drying media back to hopper 95. A discharge guide 124 is provided on unit 110 which will discharge clean polished nails ready for packing from the apparatus 110.

From the above it can be seen that a unique apparatus has been provided for continuously processing nails from a rough form state to a polished and clean state suitable for packing and shipping. As described, the unique apparatus includes a separating, cleaning, polishing, and drying functions in a continuous order such that without any manual labor being necessary the nails are completely processed and ready for packing.

From the above it will be apparent the apparatus disclosed is suitable for carrying out the unique method for the finishing of nails for shipment. The unique method is comprised of the steps of: (a) vibrating the nails to separate dirt and unwanted particles therefrom, (b) cleaning the nails by vibrating same while spraying a detergent solution thereover, (c) vibrating the nails to remove detergent and unwanted particles therefrom, (d) polishing and drying the nails by means of vibrating and oscillating of the nails within a polishing and drying media, (e) heating the nail and media mix to assist in drying, and (f) separating the finished nails from the media by vibrating same. All of the steps described are carried out in continuous order as nails are moved through the apparatus to provide a continuous flow of clean and polished nails.

The various features of the invention have been particularly shown and described, however, it should be obvious to one skilled in the art that modifications may be made therein without departing from the scope of the invention.

I claim:

1. A process for treating nails comprising the steps in sequence of:

a. providing a continuous flow of nails which may include unwanted particles of matter mixed therewith from a source, b. subjecting the nails to a vibratory separating mechanism to remove unwanted particles of matter, c. cleaning the nails by moving same through a first vibratory trough while flowing cleaning solution over the nails, d. polishing and drying the nails by moving same through a second vibratory trough filled with a drying and polishing media to thereby mix and agitate the nails with the media, and (e) separating the used media from the nails, whereby polished and clean nails are produced in a continuous manner.

2. A process as claimed in claim 1 wherein including the step of subjecting the nails to another vibratory separating mechanism between the cleaning and polishing and drying steps.

3. A process as claimed in claim 1 wherein the polishing and drying step includes the step of heating the nail and media mix.

4. A process as claimed in claim 3 wherein the media used is comprised of ground and dried corncobs and the cleaning solution is applied to said first trough by spraying it over the nails therein.

5. A process as claimed in claim 1 wherein the polishing and drying step includes the step of supplying the used media to the second vibratory trough for reuse.

6. An apparatus for processing nails comprised of means for providing a continuous source of nails, which nails may include admixed unwanted particles of matter, a vibratory separating mechanism connected to said means for providing nails and operating to remove unwanted particles of matter, a vibratory cleaning apparatus connected to said separating mechanism including a first vibratory trough with means to flow cleaning solution over the nails in said first trough, and a vibratory polishing and drying apparatus connected to said cleaning apparatus and including a second vibratory trough with means to supply a drying and polishing media over nails in said second trough and means for separating the used media from the nails, said apparatus for processing nails being adapted to produce clean and polished nails in a continuous order.

7. An apparatus as claimed in claim 6 wherein the polishing and drying apparatus includes heating means for the nails and media.

8. An apparatus as claimed in claim 7 wherein the means to flow cleaning solution includes means for spraying said cleaning solution over the nails in said first trough.

9. An apparatus as claimed in claim 6 wherein the polishing and drying apparatus includes means for supplying the used media to the polishing and drying apparatus for reuse.

10. An apparatus as claimed in claim 6 wherein another vibratory separating mechanism is provided connected between said cleaning apparatus and said polishing and drying apparatus.

* * * * *